United States Patent [19]

Andonov et al.

[11] 4,453,678

[45] Jun. 12, 1984

[54] APPARATUS FOR THE FORMATION OF YARN PACKAGES

[75] Inventors: Blagoy A. Andonov; Yordan V. Pirgov, both of Sofia, Bulgaria

[73] Assignee: Institute PO Obleklo I Textil, Sofia, Bulgaria

[21] Appl. No.: 377,973

[22] Filed: May 13, 1982

[30] Foreign Application Priority Data

May 13, 1981 [BG] Bulgaria ..... 52058

[51] Int. Cl.[3] ..... B65H 54/10; B65H 54/16; B65H 54/36

[52] U.S. Cl. ..... 242/27; 242/31; 242/158 B; 242/175; 242/176

[58] Field of Search ..... 242/27, 31, 26.1, 26.2, 242/26.3, 26.4, 26.5, 18 R, 18 G, 43 R, 43.1, 158 B, 174, 175, 176, 177, 178

[56] References Cited

U.S. PATENT DOCUMENTS

| | | | |
|---|---|---|---|
| 49,582 | 8/1865 | Bradford | 242/27 |
| 172,298 | 1/1876 | Campbell | 242/27 |
| 2,602,607 | 7/1952 | Calvi | 242/27 X |
| 2,764,363 | 9/1956 | Stammwitz | 242/26.2 |
| 3,039,708 | 6/1962 | Chidgey, Jr. et al. | 242/158 B X |
| 3,093,344 | 6/1963 | Lamb | 242/158 B X |
| 3,169,714 | 2/1965 | Schippers | 242/18 R |
| 3,400,594 | 9/1968 | Steyh | 242/158 B X |
| 3,902,676 | 9/1975 | Sartori | 242/43 R |
| 4,114,821 | 9/1978 | Thoma et al. | 242/43 R |

FOREIGN PATENT DOCUMENTS

| | | | |
|---|---|---|---|
| 496055 | 11/1950 | Belgium | 242/18 G |
| 2914179 | 10/1980 | Fed. Rep. of Germany | 242/158 B |
| 413448 | 4/1946 | Italy | 242/158 B |
| 280978 | 11/1927 | United Kingdom | 242/176 |
| 162279 | 4/1964 | U.S.S.R. | 242/18 G |

*Primary Examiner*—Stanley N. Gilreath

[57] ABSTRACT

Apparatus for the formation of packages of elongated flexible material wound upon a pirn supported and rotated in the apparatus, the apparatus having an operating carriage mounted for reciprocation parallel to the axis of the pirn, mechanism for reciprocating the operating carriage with a basic reciprocating movement lengthwise of the pirn, a vibrator mounted upon the operating carriage, a thread guide vibrated by the vibrator in a direction lengthwise of the pirn with an amplitude which is a fraction of the amplitude of reciprocation of the operating carriage, and a controlling mechanism for insuring the periodic translational shifting of the thread guide to the top of the pirn. The operating carriage is mounted upon guideways fixed to the body of the apparatus and extending parallel to the axis of the pirn, a driving belt for the carriage having spaced parallel runs thereof extending parallel to the carriage, the carriage being selectively clamped to one or the other of the rectilinear runs of the driving belt so as to drive the carriage in the direction of the run of the belt thus gripped. The controlling mechanism comprises a controlling belt stretched between rollers at the opposite ends of the body of the apparatus, the controlling belt bearing switching dogs for controlling the mechanism which selectively clamps the carriage to one or the other of the rectilinear runs of the driving belt.

5 Claims, 3 Drawing Figures

APPARATUS FOR THE FORMATION OF YARN PACKAGES

This invention relates to an apparatus for the formation of yarn packages.

U.K. Pat. No. 1,569,160 discloses an apparatus for the winding of a flexible filament or yarn on a pirn, such apparatus including a mechanism for supporting and rotating the pirn, a shaft, mechanism comprising an eccentric for imparting a basic reciprocating movement to the shaft, such basic reciprocating movement having a length several times smaller than the length of the pirn, a carriage mounted on the shaft by a screw, mechanism for the translational periodic movement of the carriage along the length of the shaft toward the top of the pirn, a thread guide mounted upon the carriage, and a mechanism for imparting a second reciprocating motion of the thread guide with a higher frequency than that of the basic reciprocation of the carriage, the amplitude of said second reciprocating motion being smaller than that of the basic reciprocating motion.

The control of the above-described prior art apparatus is effected by an ordinary power supply circuit, comprising an electric motor, a transformer, distributing devices, which insure the switching-in of the electric motor and keeping it in action during the normal running of the process of winding the yarn, as well as its switching-off upon a disturbance of the process, apparatuses for protection of the apparatus upon an increase in the current flow, due to overloading at the moment of starting the electric motor, as well as increase in current flow due to damage of the apparatus or to short circuit.

The above-described prior art device has some disadvantages which limit its wider application, including the complete exhaustion of the possibilities of the use of such winding method. First of all, it requires a design of the pirn having a precisely defined form in order to achieve an accurate cylindricity of the ready-made package. When changing the linear density (tex, den.) of the wound yarn, the change of the angle of the periodic shaft rotation has to adjusted. The availability of an eccentric leads to an exactly defined height of the cone of the pirn, unchanging with all linear densities of the wound threads. These restrictions of the apparatus prevent the selection of optimal speed and geometrical parameters of the winding process with a given linear density and type of yarn, i.e. it is not possible to create favorable conditions to achieve the maximum possible speeds of winding of a given yarn while forming a stable construction and reaching the maximum weight of the ready-made package. On the other hand, the unchangeable amplitude of the range of the eccentric restricts the application of the device to a defined size of the packages produced thereby.

The disadvantage of the controlling prior art method is that it can serve only for driving devices which are not electromechanical and have only a motor for imparting rotation to the pirn, which motor in its part, through the mechanisms of the device, serves for the creation in a mechanical manner of the required rotary and reciprocating motions for the yarn winding according to a given method.

The present invention has among its objects the provision of a device for the formation of packages, with the possibility for a rapid adjustment of the extent of the basic reciprocating movement over wide ranges and simultaneously with the automatic formation of the cylindrical pirn irrespective of the linear density of the wound yarn, and the form and the size of the package, by insuring the conditions for achieving the maximum possible speeds for winding, weight of the package with a given linear density, type of yarn, and size of the empty spool.

The above objects are achieved by the apparatus of the present invention. Such apparatus comprises a mechanism for rotating a pirn, a thread guide mounted upon a vibrator fixed to an operating carriage of a mechanism for a basic reciprocating movement of the thread guide, a controlling mechanism which insures the periodic translational shifting of the thread guide toward the top of the beginning, larger diameter end of the pirn. The operating carriage is mounted upon guiding ways fixed to the body of the apparatus and extending parallel to the axis of the pirn. The two rectilinear portions of the path of a driving belt for the operating carriage pass through the carriage, such belt being stretched between rollers at the opposite ends of the apparatus. The controlling mechanism comprises a controlling belt, stretched between the rollers, the controlling belt also having parallel runs extending parallel to the axis of the pirn. The controlling belt has two confronting ends which are affixed to the operating carriage. Upon the controlling belt, at one end of the operating carriage, there is affixed a switching-in element with a pushing arm, and spaced from the switching-in element there is a switching-off element. Between the switching-in element and the switching-off element and mounted upon the guiding ways there is disposed a controlling electromechanical device which comprises a controlling carriage a controlling carriage, which moves periodically to the top of the pirn, and upon which a switching block is mounted, said switching block having a switching element and a controlling transducer. The controlling transducer insures a command for periodic movement of the controlling carriage, including a sensing arm mounted upon a fixed axis extending from the commanding or controlling carriage, and a normally closed switch, one pole of the switch being fixed to the commanding carriage and the other pole of the switch being fixed to the sensing arm. Two electromagnets are mounted on an operating carraige, the electromagnets operating respective clamping elements which selectively engage the oppositely disposed and oppositely running parallel portions of the driving belt. The connection between the operating carriage and the commanding carriage is achieved by an electrical control circuit which comprises an electromagnetic relay with a normally opened switch, a normally closed switch and a solenoid coil for operating such relay. The two ends of the solenoid coil are connected in parallel with the coil of the electromagnet, one of such ends thereof being connected through the switching block to the controlling transducer, and the other end thereof being connected with the joint point of one of the ends of the coil of the other electromagnet and the negative pole of the DC current source. The ends of the normally opened switch are connected in parallel with the controlling transducer. The one end of the normally closed switch is connected in series with the coil of the other electromagnet, and the other end is connected with the joint point of the controlling transducer and the positive pole of the transducer.

The advantages of the apparatus according to the invention are that it insures the possibility for the formation of a cylindrical package irrespective of the form of the empty spool, without the necessity of regulating the apparatus with a change of the linear density of the wound yarn, thus making possible the winding of pirns with a wide range of lengths and diameters from spools or bobbins for use in weaving to bottle types of spools. Another advantage of the invention is that the speed and geometric parameters of the process of winding with a given linear density and type of yarn are adjustable, i.e. there is a possibility of creating favorable conditions for reaching the maximum possible speeds of winding the yarn while forming a stable construction, and reaching the maximum height of readymade packages.

A preferred embodiment of the apparatus in accordance with the invention is shown in the accompanying drawings, wherein.

Figure 1:
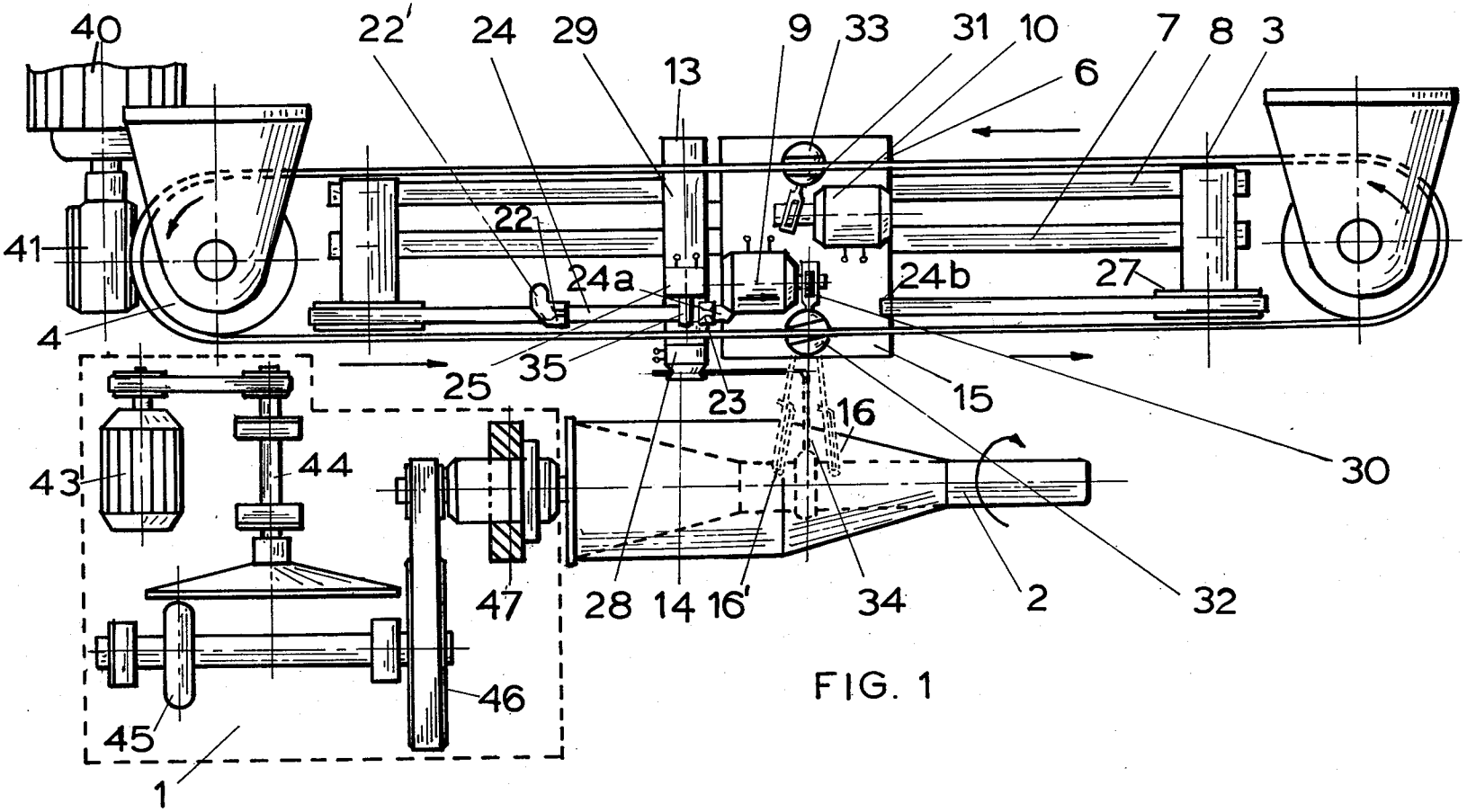
FIG. 1 is a schematic view of the apparatus of the invention in plan.
Figure 2:
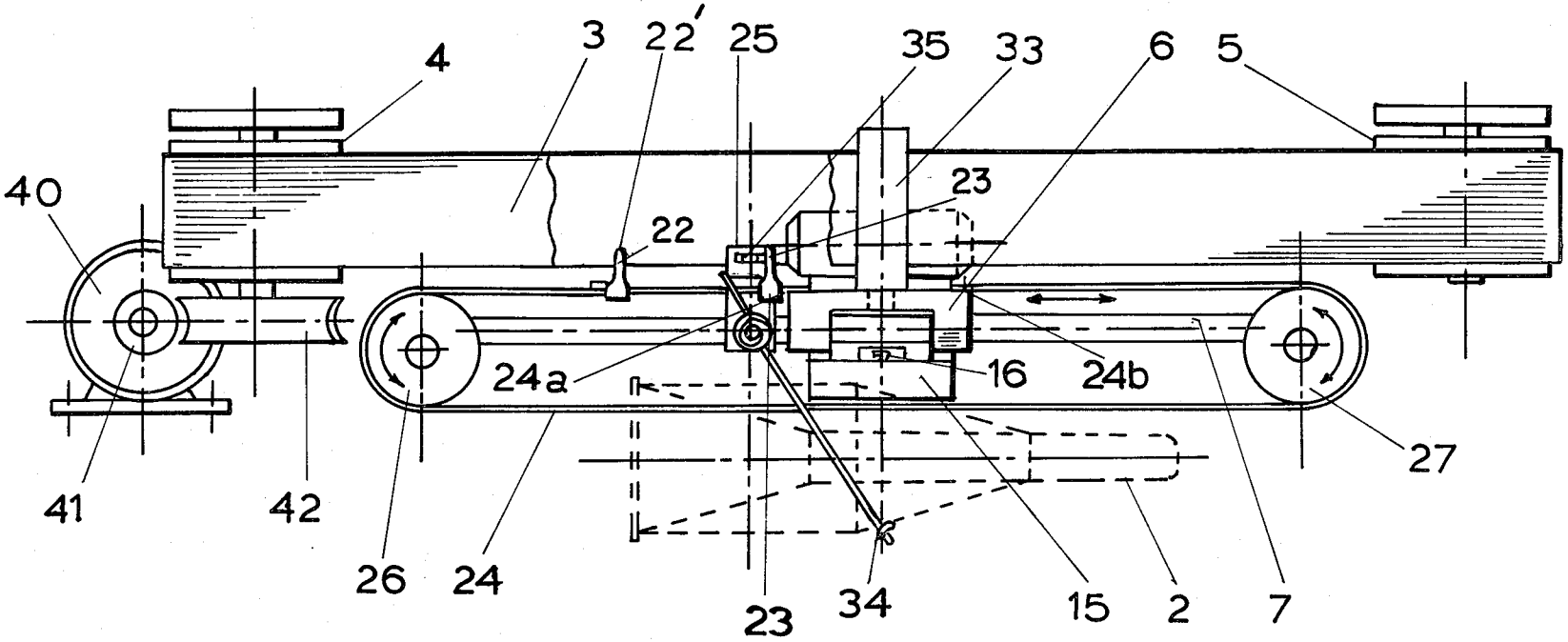
FIG. 2 is a front elevation of the apparatus shown in FIG. 1.

As shown in FIG. 1, the apparatus includes a driving mechanism 1 for rotating the pirn 2, driving mechanism 1 including a motor 43 driving a shaft 44 which in turn drives an adjustable friction driving mechanism 45. Mechanism 45 drives a pirn mounting and driving mechanism 47 through a speed multiplying pulley and belt system 46. A pair of spaced parallel guidingways 7 and 8, which are fixed to the body of the apparatus, extends to the axis of the pirn 2. Mounted upon guideways 7 and 8 is an operating carriage 6 which reciprocates on the guideways, there being a vibrating thread guide 16 mounted upon a vibrator 15 secured to the operating carriage 6, the thread guide vibrating rapidly between the the broken-line positions 16, 16′ thereof shown in FIG. 1. The distance between positions 16 and 16′ is several times smaller than the range of reciprocatory travel of the operating carriage 6.

Carriage 6 is reciprocated in the following manner: an endless driving belt 3 extends between spaced pulleys 4 and 5 which are disposed, respectively, beyond the opposite ends of the guideways 7 and 8. A motor 40 continuously drives the belt 3 in one direction, as indicated by the arrows in FIG. 1, through the medium of a worm 41 mounted on the shaft of the motor, worm 41 meshing with a worm gear 42 which is affixed to the shaft upon which the pulley 4 is mounted. The opposite runs of the belt 3 pass through clamping means 32 and 33, respectively, which are mounted upon the operating carriage 6. Clamping means 32 and 33 in the embodiment shown take the form of vertical cylinders which are diametrically slotted, the slots receiving the runs of the belt as shown. The cylinders are selectively rotatable between a position wherein the slot therein extends parallel to the run of the belt passing through it (see the element 33 in FIG. 1) and a position in which the cylindrical element is turned about its axis sufficiently for the run of the belt passing through the slot therein to be clamped thereby (see element 32 in FIG. 1). With members 32 and 33 in the positions thereof shown in FIG. 1, the operating carriage 6 is driven by the belt 3 in the direction from left to right. When the element 32 is turned clockwise so that its slot lies parallel to the run of the belt passing therethrough, and the element 33 is turned counterclockwise so that the run of the belt passing through the slot therein is gripped by element 33, the operating carriage 6 is driven in the direction from right to left. Element 32 is selectively turned about its axis between the two above-described positions thereof by an electromagnet 9 and a pin and slot mechanism 30, whereas the element 33 is selectively turned about its axis by an electromagnet 10 operating through a pin and slot connection 31.

The electromagnets 9 and 10 are under the control of a commanding mechanism which insures the reciprocating movement of the carriage 6 and the thread guide 16 mounted thereon toward the top of the pirn and then in the opposite direction. The commanding mechanism includes a controlling belt 24 and an electromagnetic control 13 (FIG. 1). The controlling belt 24 is stretched between two pulleys 26, 27 mounted on shafts disposed normal to the length of and beyond the respective ends of the guideways 7 and 8. Belt 24 extends parallel with the axis of the pirn 2, with the opposite straight runs of the belt 3, and with the guiding members 7 and 8. The belt 24 has opposite ends 24*a* and 24*b* affixed to the opposite ends of the operating carriage 6. Upon the upper run of the controlling belt 24 in the lefthand portion thereof are mounted a switching-in element 22 and spaced therefrom to the right a switching-off element 23. Elements 22 and 23 are held upon the controlling belt 24 by suitable clamping means, so that such elements may be adjusted longitudinally of the controlling belt 24 as desired and as needed for the winding of pirns under different conditions such as pirns having different parameters and yarns or filaments having different parameters.

A commanding electromechanical device comprises a commanding carriage 29, which is mounted for periodic translational movement upon guideways 7 and 8, between the switching-in element 22 and the switching-off element 23. Upon the commanding carriage 29 there is mounted a switching block 25 with a switching-in element or dog 35 which is disposed in the paths of and between elements 22 and 23, and a controlling transducer 28. The commanding carriage 29 moves periodically to the top of the pirn by a pushing arm 22′ of the switching-in element 22. The controlling transducer, which insures a command for periodic movement, comprises a sensing arm 34 which is mounted upon a stub shaft 14 having a fixed axis, stub shaft 14 being fixed to the commanding carriage 29, and a switch a normally closed 36 (FIG. 3) which forms a part of a controlling transducer 28 (FIG. 1). The two poles of the switch 36 are fixed respectively to the commanding carriage and the sensing arm. As shown in FIG. 1, there are two electrical leads from the controlling transducer 28, and there are two electrical leads from the switching block 25. The switching block 25 has two positions, the first one a passage and the second one for a disconnection of the current running through it, under the action of the switching-in element 22 or the switching-off element 23, respectively. The manner in which the various above-described elements of the apparatus are connected is shown in the wiring diagram 11 of FIG. 3.

Figure 3:
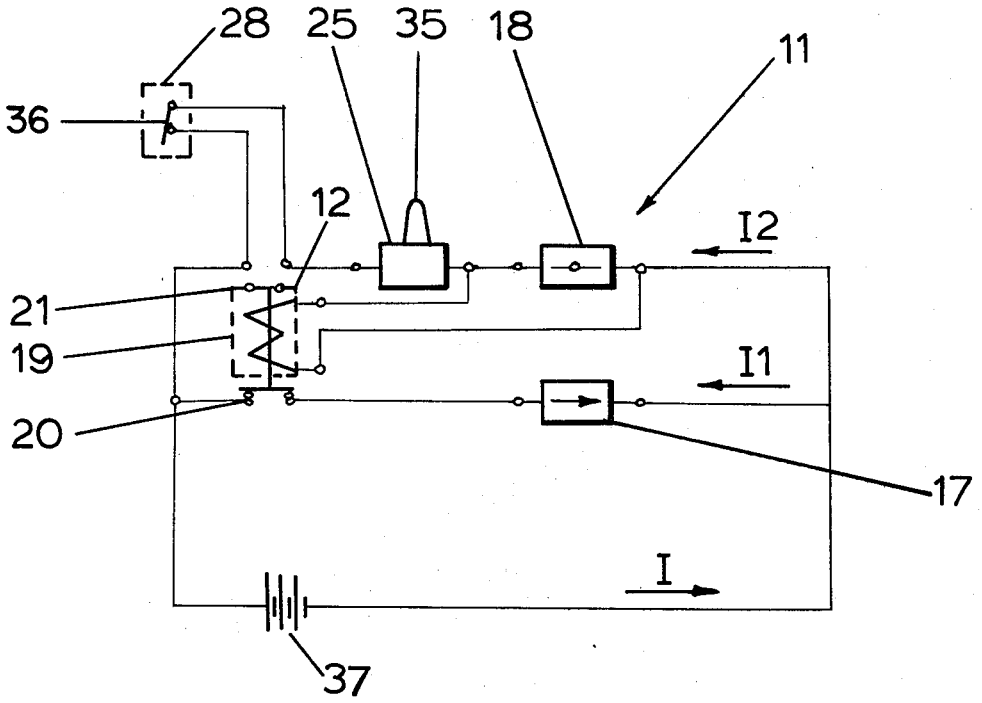
FIG. 3 is a diagram of the circuit for the control of the apparatus.

In FIG. 3 there is shown an electromagnet relay 19 having a lower set of contacts 20 which are normally closed, and an upper set of contacts 21 which are normally open, relay 19 having a solenoid coil 12. A DC current source 37 in the form of a battery is shown and wire extnding from the negative pole of source 37 is divided into two wires, I 1, I 2 which pass through contacts 20, 21, respectively, and then the wires I 1, I 2 being connected together through the positive pole of source 37 to create closed citcuits. Prior to the set of contacts 20 on the path of wire I 1 there are connected in series the leads of solenoid coil 17 of the electromagnet 9. Prior to the set of contacts 21 on the path of wire I 2 there are connected in series the leads of solenoid coil 18, of electromagnet 10 and leads of the switching block 25. The leads of solenoid coil 12 are connected parallel to the leads of the coil 18. The two lead wires from the controlling transducer 28 are connected parallel to the normally open upper contacts of the switch 21.

Upon switching-on the apparatus at the start of the winding operation, the switching-in element 35 of the switching block 25 is in the position which it assumes when no electric current passes through the coil 18. This results in energizing the coil 17 of electromagnet 9, i.e. the current passes through normally closed switch contacts 20 of the electromagnet relay 19. In this state, the carriage 6 shifts toward the right, that is, toward the top of the pirn 2 since the electromagnet 9 acting through the operation element 30 clamps the operating element 32 to the belt 3 as it travels to the right. Simultaneously with the shifting of the operating carriage 6 to the right the element 22 engages the switching-in element 35 so that the switching-in element 35 is "switched-in". The coil 12 of the electromagnet relay 19 is then energized, thereby closing the normally open switch contacts 21, and opening the normally closed switch contacts 20. Such operation results in the deenergization of coil 17 of electromagnet 9 and the energization of coil 18 of electromagnet 10. Thereupon operating elements 30 and 32 operate to release the clamping engagement of element 32 upon the belt 3, and to cause operating element 33 to grip the other run of belt 3. This results in the stopping of the travel of the operating carriage 6 to the right and the starting of its return travel to the left.

Meanwhile, the vibrating thread guide 16 continues to perform its additional micro-reciprocation. The extent of the basic reciprocating movement of the carriage 6 is regulated by a change of the distance on the controlling belt 24 between the switching-in and switching-off elements 22 and 23, respectively.

Upon reaching a preliminarily defined size of the larger diameter of the cone surface of winding, the controlling transducer 28 for the shifting of the operating carriage 6 to the right, that is to the top of pirn 2, gives a signal for disconnecting, or directly by its normally closed switch interrupts the circuit connected to the normally opened switch contacts 21. In this condition, after the carriage 6 has reached the end of the forward motion of its basic reciprocation, current can not pass through the coil 18 in spite of the switching-in of the switching block 25. Thus the operating carriage 6 continues its movement forward, and the pushing arm 22I pushes the body of the commanding carriage 29 forward to the smaller diameter of the cone surface of winding as the diameter, controlled by the transducer 28, decreases; this leads to an immediate closing of the electric circuit in which the coil 18 is included, and the operating carriage 6 begins its basic reciprocation in a new position, shifted to the right toward the top of the pirn. This action of the mechanism is repeated until the package has been completely formed, ending with a frustum of a cone at the right, and having a cylindrical body.

Although the invention is illustrated and described with reference to one preferred embodiment thereof, it is to be expressly understood that it is no way limited to the disclosure of such preferred embodiment but is capable of numerous modifications within the scope of the appended claims.

We claim:

1. Apparatus for the formation of packages of elongaged flexible material wound upon a pirn, comprising a body means on the body for supporting and rotating the pirn, an operating carriage mounted for reciprocation parallel to the axis of the pirn, means for reciprocating the operating carriage with a basic reciprocating movement lengthwise of the pirn, a vibrator mounted upon the operating carriage, a thread guide vibrated by the vibrator in a direction lengthwise of the pirn with an amplitude which is a fraction of the amplitude of reciprocation of the operating carriage, a controlling mechanism for insuring the periodic translational shifting of the thread guide to the top of the pirn, the operating carriage being mounted upon guideways fixed to the body of the apparatus and extending parallel to the axis of the pirn, a driving belt for the carriage having spaced parallel runs thereof extending parallel to the carriage, means on the carriage selectively clamping the carriage to one or the other of the rectilinear runs of the driving belt so as to drive the carriage in the direction of the run of the belt thus gripped, the controlling mechanism comprising a controlling belt stretched between rollers at the opposite ends of the body of the apparatus, the controlling belt having its opposite ends secured to the operating carriage, upon the controlling belt at one side of the operating carriage there being fixed a switching-in element with a pushing arm and a switching-off element, between the switching-in and switching-off elements there being disposed a commanding electromechanical device, such commanding electromechanical device comprising a controlling carriage upon which there is mounted a switching block with a switching-in dog disposed between the switching-in element and the switching-off element on the controlling belt, the commanding electrodmechanical device also including a controlling transducer mounted upon the controlling carriage for commanding the periodic translational shift of the operating carriage to the top of the pirn and therewith the thread guide.

2. Apparatus according to claim 1, wherein the controlling transducer comprises a winding sensing arm mounted upon an immovable axis on the controlling carriage, and a normally closed switch, the two poles of the switch being fixed, respectively, to the controlling carriage and the sensing arm.

3. Apparatus according to claim 1, wherein the operating carriage comprises two electromagnets to which there are mounted respective operating elements by which the opposite runs of the driving belt may be selectively clamped to the operating carriage to drive it in one or the other direction.

4. Apparatus according to claim 1, or claim 2, or claim 3, wherein the connection between the operating carriage and the controlling carriage is achieved by an electric control circuit, said electric control circuit comprising an electromagnetic relay with a normally closed lower set of contacts, and a normally open upper set of contacts and a solenoid coil, a DC current source, and wire extending from the negative pole of the said source is divided into two wires, which pass through the normally closed set of contacts and the normally open set of contacts, respectively, and then the two wires are connected together through the positive pole of the source to create closed circuits, and prior to the normally closed set of contacts, on the path of one of the two wires there are connected in series leads of solenoid coil of one of the two electromagnets of the clamping means, and prior to the normally open set of contacts on the path of the other wire there are connected in series leads of solenoid coil of the second electromagnet of the clamping means and leads of the switching block, and the leads of the solenoid coil of the relay are connected parallel with the leads of the solenoid coil of the second electromagnet, and two wires extending from the normally closed switch of the controlling transducer are connected parallel to the normally open upper set of contacts of the relay.

5. Apparatus for the formation of packages of elongated flexible material wound upon a pirn, comprising a body, means on the body for supporting and rotating the pirn, an operating carriage mounted for reciprocation parallel to the axis of the pirn, means for reciprocating the operating carriage with a basic reciprocating movement lengthwise of the pirn, a vibrator mounted upon the operating carriage, a thread guide vibrated by the vibrator in a direction lengthwise of the pirn with an amplitude which is a fraction of the amplitude of reciprocation of the operating carriage, a controlling mechanism for insuring the periodic translational shifting of the thread guide to the top of the pirn, the operating carriage being mounted upon guideways fixed to the body of the apparatus and extending parallel to the axis of the pirn, a driving belt for the carriage having spaced parallel runs thereof extending parallel to the carriage, means on the carriage selectively clamping the carriage to one or the other of the rectilinear runs of the driving belt so as to drive the carriage in the direction of the run of the belt thus gripped, the controlling mechanism comprising an elongated member secured to the operating carriage and extending parallel to the guideways beyond one side of the carriage, upon the elongated member at said one side of the operating carriage there being mounted a switching-in element with a pushing arm and a switching-off element spaced from the switching-in element, between the switching-in and switching-off elements there being disposed a commanding electromechanical device, such commanding electromechanical device comprising a controlling carriage mounted on the guideways and movable therealong, a switching block with a switching-in dog mounted on the controlling carraige and disposed between the switching-in element and the switching-off element on the elongated member, the commanding electromechanical device also including a controlling transducer operated by a winding sensing means mounted upon the controlling carriage.

* * * * *